US008991672B2

(12) United States Patent
Hassler

(10) Patent No.: US 8,991,672 B2
(45) Date of Patent: Mar. 31, 2015

(54) TOOL POUCH WITH ROTATABLE COVER

(71) Applicant: Mathew Ryan Hassler, San Antonio, TX (US)

(72) Inventor: Mathew Ryan Hassler, San Antonio, TX (US)

(73) Assignee: Rooster Products International, Inc., San Antonio, TX (US)

( * ) Notice: Subject to any disclaimer, the term of this patent is extended or adjusted under 35 U.S.C. 154(b) by 0 days.

(21) Appl. No.: 14/312,600

(22) Filed: Jun. 23, 2014

(65) Prior Publication Data

US 2014/0374293 A1 Dec. 25, 2014

Related U.S. Application Data

(63) Continuation-in-part of application No. 29/494,263, filed on Jun. 18, 2014.

(60) Provisional application No. 61/837,850, filed on Jun. 21, 2013.

(51) Int. Cl.
*B25H 3/00* (2006.01)

(52) U.S. Cl.
USPC ..... 224/674; 224/663

(58) Field of Classification Search
CPC ..... B25H 3/00; A45F 5/02; A45F 5/021; A45F 5/00
USPC ..... 224/674, 663
See application file for complete search history.

(56) References Cited

U.S. PATENT DOCUMENTS

| | | | | | |
|---|---|---|---|---|---|
| 4,892,241 | A * | 1/1990 | Mavrakis | 224/640 |
| 4,911,292 | A * | 3/1990 | Airey, Jr. | 206/315.3 |
| 5,695,098 | A * | 12/1997 | King | 224/148.7 |
| 5,862,526 | A * | 1/1999 | Longcor et al. | 2/338 |
| 6,082,600 | A * | 7/2000 | Angus et al. | 224/269 |
| 6,293,445 | B1 * | 9/2001 | Miller | 224/240 |
| 7,568,600 | B2 * | 8/2009 | Godshaw et al. | 224/429 |
| 2002/0113103 | A1 * | 8/2002 | O'Hare | 224/155 |
| 2004/0217141 | A1 * | 11/2004 | Brooks | 224/587 |
| 2006/0208025 | A1 * | 9/2006 | Grundy et al. | 224/666 |
| 2009/0039120 | A1 * | 2/2009 | Murdoch et al. | 224/195 |

* cited by examiner

*Primary Examiner* — Brian D Nash
(74) *Attorney, Agent, or Firm* — Gunn, Lee & Cave, P.C.; John C. Cave

(57) ABSTRACT

A tool pouch for securing articles therein having a pivotally attached rotatable cover. The tool pouch allows a user to insert tools and accessories within a cavity, or pocket, of the tool pouch and secure the tools and accessories therein with a cover. In a closed position, flexible portions of the cover bend around the top of the side panels to hold the cover secure. When the cover is moved to an opened position, the flexible portions of the cover negotiate over the corners allowing the cover to be moved. In the second position, the flexible portions of the cover bend around the sides of the front panel and hold the cover secure. The cover may be readily operable and, in some implementations, can reside in the opened and/or closed position even if the tool pouch is radically reoriented. The cover also may allow easy access to the stored items when in the opened position.

16 Claims, 7 Drawing Sheets

TOOL POUCH WITH ROTATABLE COVER

CROSS REFERENCE TO RELATED APPLICATIONS

This original non-provisional application claims priority to and the benefit of U.S. provisional application Ser. No. 61/837,850, filed Jun. 21, 2013, and entitled "Secure Tool Pouch," and is a continuation in part of and claims priority to U.S. non-provisional, design patent application Ser. No. 29/494,263, filed Jun. 18, 2014, and entitled "Tool Pouch With Rotatable Cover," which are incorporated by reference herein.

STATEMENT REGARDING FEDERALLY SPONSORED RESEARCH OR DEVELOPMENT

None.

BACKGROUND OF THE INVENTION

1. Field of the Invention

The present invention relates generally to tool pouches, and in particular, to tool pouches having a pivotally attached cover for securing articles therein.

2. Description of the Related Art

Tool pouches (e.g., bags and belts) are used every day by a variety of construction workers (e.g., carpenters, electricians, plumbers, etc. . . . ). Designing the proper pockets, hangers, and the like for tool pouches is difficult, however, because every trade requires a different set of tools (e.g., hammers, tape measures, screwdrivers, squares, levels, drills, wrenches, etc. . . . ) and accessories (e.g., nails, screws, nuts, grommets, brackets, caulk, etc. . . . ), and not every job even in the same trade requires the same tools and accessories. Moreover, the needed availability of each tool and accessory may vary from job to job.

Unfortunately, various tools and accessories are relatively small and may, thus, easily fall out of a tool pouch if the worker is in the non-vertical position (e.g., when working in a crawlspace or a low-pitched attic). Several solutions exist for preventing these and other items from falling out of a tool pouch. For example, some tool pouches include a zippered cover over one or more of their pockets. When items are to be secured, the zipper is closed, and when items are to be accessed, the zipper is unzipped. As another example, some tool pouches include a drawstring bag for one or more of their pockets. The drawstring may be drawn when items are to be secured and expand when items are to be accessed. However, even when opened, zippered covers and drawstring bags can cause interference with accessing the items. For example, a zippered cover can easily fall back down over the opening of the cavity. The user may tuck the cover in the pocket to prevent this, but then the cover is where the items of interest are located.

The present invention overcomes the shortcomings of the prior art. In the present invention, various tools and accessories to be carried by a worker are stored within a tool pouch having a rotating cover. The cover is pivotally attached at each end to the sides of the tool pouch. The cover rotates between a first, or closed, position and a second, or opened, position. The cover remains secure in either position, and, thus, does not interfere with the user's access of a desired item from within the tool pouch when, for example, the cover is in the opened position. Accordingly, there is a need for a tool pouch having a pivotally attached rotatable cover for securing articles therein.

BRIEF SUMMARY OF THE INVENTION

The present invention is a tool pouch having a pivotally attached rotatable cover for securing articles therein. The tool pouch of the present invention allows a user to insert tools and accessories within the cavity, or pocket, of the tool pouch and secure the tools and accessories with a cover. Thus, the inserted articles may be retained and secured in the cavity. This is especially useful when the user must assume non-standing positions (e.g., when working in a crawl space or low-sloped attic). Moreover, the cover may be readily operable and, in some implementations, can reside in the opened and/or closed position even if the tool pouch is radically reoriented. The cover also may allow easy access to the stored items when in the opened position.

The tool pouch of the present invention is comprised of a front panel, a back panel, and two side panels. The front panel, the front surface of the back panel, and the side panels are attached together to form a cavity or pocket. The cavity or pocket may be used for storing tools and/or accessories. The tool pouch may be made of natural or synthetic materials such as polyester, nylon, leather, or polyolefin. The front panel, the back panel, and the side panels are fastened together by stitching, however, other fastening techniques, such as adhesion, riveting or the like, may be used. Reinforcement material may be added to increase the durability of the tool pouch. The reinforcement material may be made of a natural or synthetic material such as polyester, nylon, leather, or polyolefin or a high strength woven stretchable material such as elastic or the like.

The tool pouch further includes a rotatable cover. Portions of the cover consist of a flexible material. The cover has a top, two sides extending from opposing ends of the top and flexible strips therebetween. The top is substantially the same size as the opening for the cavity or pocket. Fasteners, such as rivets, may be used to pivotally attach the sides of the cover to the side panels. The sides may be reinforced at the location of the fasteners. Though rivets can be used to pivotally attach the sides of the cover to the side panel, other similar fasteners, such as snaps, buttons or the like, may be utilized.

The rotatable cover may be formed of a single piece of material, such as leather. Alternatively, each of the top, the flexible strips and the sides of the cover may also be formed of different pieces of materials. For example, the top and sides may be made up of one type of material, e.g., leather, while the flexible strips may be made of a high strength woven stretchable material such as elastic, and may be in either an unstretched or stretched configuration. The top, flexible strips, and sides of the rotatable cover may be attached to each other by stitching or other fastening techniques, such as adhesion, riveting or the like.

The tool pouch may also contain eyelets and a strap on the top of the cover. The strap can be of any stretchable material, such as bungee material or the like. The ends of the strap can be anchored to the top of the cover by, for example, placing the ends of the straps through the eyelets and knotting the ends of the strap on the opposite side of the top of the cover to secure the strap to the main portion of the cover.

The main portion of the cover may be reinforced. Reinforcement may, for example, include an extra layer of material on the top and/or adding a stiffener inside the top. The stiffener may be a sheet of polyethylene plastic or other similar material.

A first strip can be attached to the back surface of the back panel by stitching or other fastening techniques, such as adhesion, riveting or the like. The strip may be attached such that it forms a loop capable of receiving the user's belt therethrough for attaching the tool pouch to the user. A second strip may be attached to the outer surface of the first strip by stitching or other fastening techniques and forming a pocket therebetween. A clip may be attached with a portion of the clip inserted between the strips and secured with one or more fasteners, such as rivets or other similar fasteners, such as snaps, buttons or the like.

In an alternative embodiment, the fasteners on the back of the tool pouch are comprised of a single rivet or like fastener which allows the clip of the tool pouch to rotate about the rivet to allow the tool pouch to remain in an upright position even when the user is in a non-standing position. When the user is in a standing position, the tool pouch is oriented such that its position is upright with respect to the ground or surface. When the user bends down to crawl on hands and knees (e.g., when needing to enter into a crawl space), the clip of the tool pouch rotates about the single rivet so that instead of changing to a position that is parallel to the ground or surface as a result of the user changing to a crawling position, the position of the tool pouch instead remains upright with respect to the ground or surface. In doing so, the contents within the tool pouch have not shifted (or have shifted slightly) and the tool pouch may be opened without the contents spilling out. This is especially beneficial when the user is in an area with little or no light and the contents are sharpened items (e.g., small nails or other sharpened items) that could otherwise cause injury to the user if they were to spill out while the user is on hands and knees and the user happened across the spilled contents in such a confined area.

In operation, when the cover is in a closed position (i.e., the cavity is closed), the flexible strips of the cover bend around the top edges of each side panel. In the closed position, the flexible strips of the cover may be in an unstretched or stretched configuration and hold the cover secure.

When the cover is moved from the first, or closed, position to the second, or opened, position, the flexible strips of the cover necessarily stretch to negotiate over the corners where the top edge of the front and the top edges of each, and side panel intersect and allow the cover to be rotated. In transition, after the cover has moved from its first, or closed, position but before the cover reaches the second, or opened, position, the cover is in state where the cavity is partially exposed.

As the flexible strips of the cover pass over the corners, the points of contact between the corners and the flexible strips cause the flexible strips (and the area within the flexible strips immediately surrounding the points of contact) to stretch (i.e., stretched configuration). The location of where the corners contact the flexible portions of the cover moves as the cover rotates and moves over the corners and toward the second, or opened, position. For example, with reference to just one side of the cover (as both sides are identical), as the flexible strip continues to cross over the corner, the stretched area of the flexible strip "moves" from the front end of the flexible strip towards the back end of the flexible strip until the flexible portion has cleared the corner and the cover is in the second, or opened, position. When the cover reaches the opened position, the flexible strip of the cover bends around the sides of the front panel and holds the cover secure.

The user may expose the cavity or pocket of the tool pouch (i.e., open the tool pouch) by physically rotating the cover, e.g., as with the user's hand, about the fasteners attaching the end portions of the cover to the side panels. Alternatively, the user may also expose the cavity or pocket of the tool pouch by rotating the cover in a similar fashion but now by pulling on the strap attached to the cover in a direction away from the back panel and toward the front panel. To close the tool pouch, the user would pull on the strap on the cover in a direction away from the front panel and toward the back panel.

In either the closed or the opened position, the flexible material of the flexible strip secures the cover in that position so that absent the user moving the cover, the cover stays in place. Fasteners, such as rivets, secure the cover in place yet allow the cover to rotate about the fastener between a first position and a second position. In addition, the tool pouch can be coupled to various devices, such as a belt or utility belt, through coupling devices, such as a loop or clip.

DETAILED DESCRIPTION OF THE INVENTION

Figure 1:
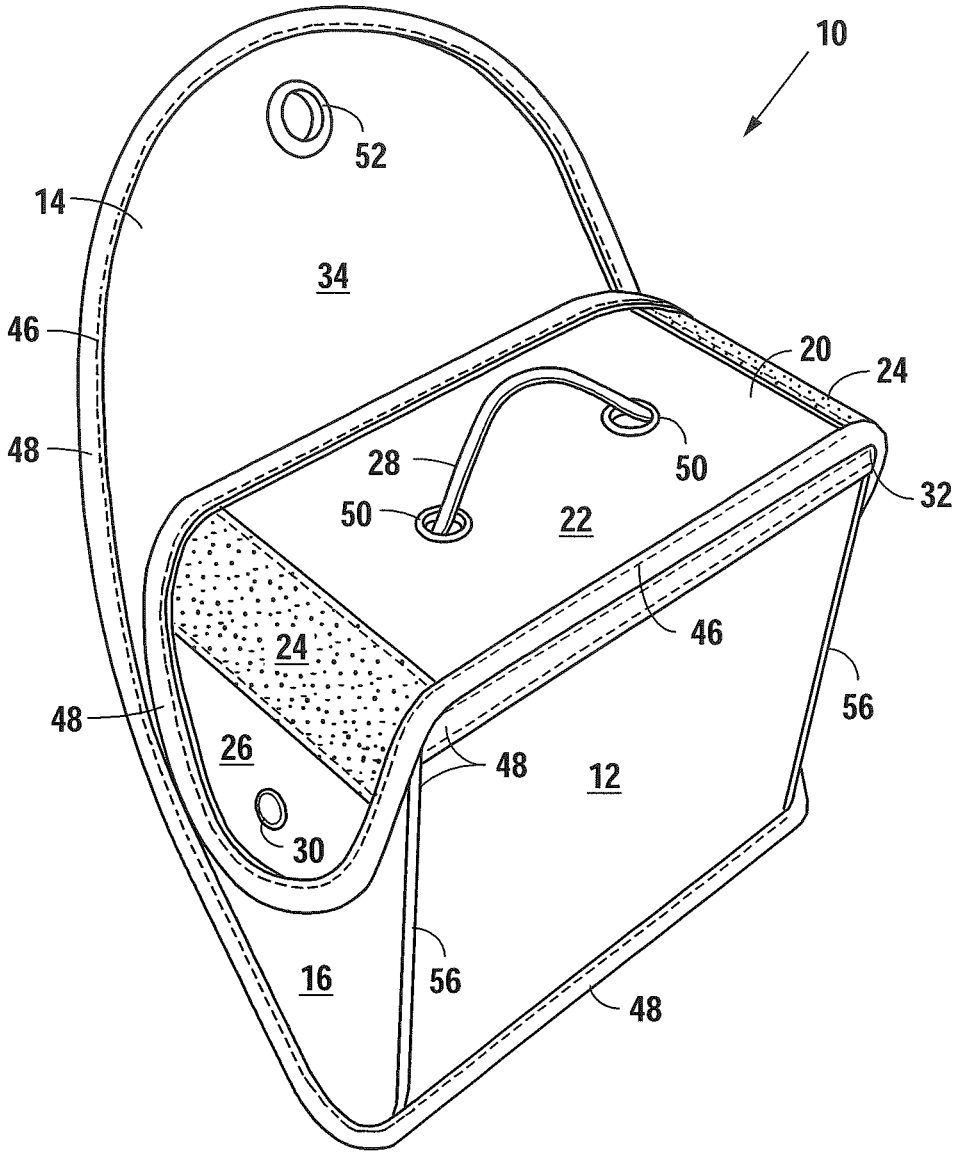
FIG. 1 is a left side frontal perspective view of the present invention.

FIG. 1 depicts the preferred embodiment of the present invention. Tool pouch 10 is comprised of a front panel 12, a back panel 14, and two side panels 16. Front panel 12, front surface 34 of back panel 14, and side panels 16 are attached together to form a cavity 18 (see FIGS. 4-6) which may be used for storing tools and/or accessories. Tool pouch 10 may be made of a natural or synthetic material such as polyester, nylon, leather, or polyolefin. Preferably, front panel 12, back panel 14, and side panels 16 are fastened together by stitching 46, however, other fastening techniques, such as adhesion, riveting or the like, may be used. Strips of reinforcement material 48 may be added to increase the durability of tool pouch 10. Reinforcement material 48 may be made of a natural or synthetic material such as polyester, nylon, leather, polyolefin, or a high strength woven stretchable material such as elastic or the like.

Tool pouch 10 further includes a cover 20. Cover 20 has a top 22, two sides 26 extending from opposing ends of the top 22 and flexible strips 24 therebetween. Top 22 is substantially the same size as the opening for cavity 18. Rivets 30 (only one of which is viewable) attach each of sides 26 of cover 20 to side panels 16. Sides 26 may be reinforced at the location of rivets 30. Though rivets are disclosed in this embodiment, other similar fasteners, such as snaps, buttons or the like, may be utilized.

Cover 20 may be formed of a single piece of material, such as leather. Alternatively, each of top 22, flexible strips 24 and sides 26 of cover 20 may also be formed of different pieces of materials. For example, top 22 and sides 26 may be made up of one type of material, e.g., leather, and flexible strips 24 may be made of a high strength woven stretchable material such as elastic or the like, and may be in either an unstretched or stretched configuration. Top 22, flexible strips 24 and sides 26 of cover 20 may be attached to each other by stitching 46, however, other fastening techniques, such as adhesion, riveting or the like, may be used.

Tool pouch 10 may also contain eyelets 50 and strap 28 on main portion 22 of cover 20. Strap 28 can be of any stretchable material, such as bungee material or the like. The ends of strap 28 (not shown) can be anchored to top 22 of cover 20 by, for example, placing the ends of straps 28 through eyelets 50 and knotting the ends of strap 28 on the opposite side of top 22 of cover 20 to secure strap 28 to top 22 of cover 20. Eyelets 50 may be reinforced with metal or other similar resilient material to prevent tearing of main portion 22 of cover 20.

Top 22 may be reinforced. Reinforcement may, for example, include an extra layer of material (not shown) on main portion 22 and/or adding a stiffener inside main portion 22 (not shown). The stiffener may be a sheet of polyethylene plastic or other similar material.

Figure 2:
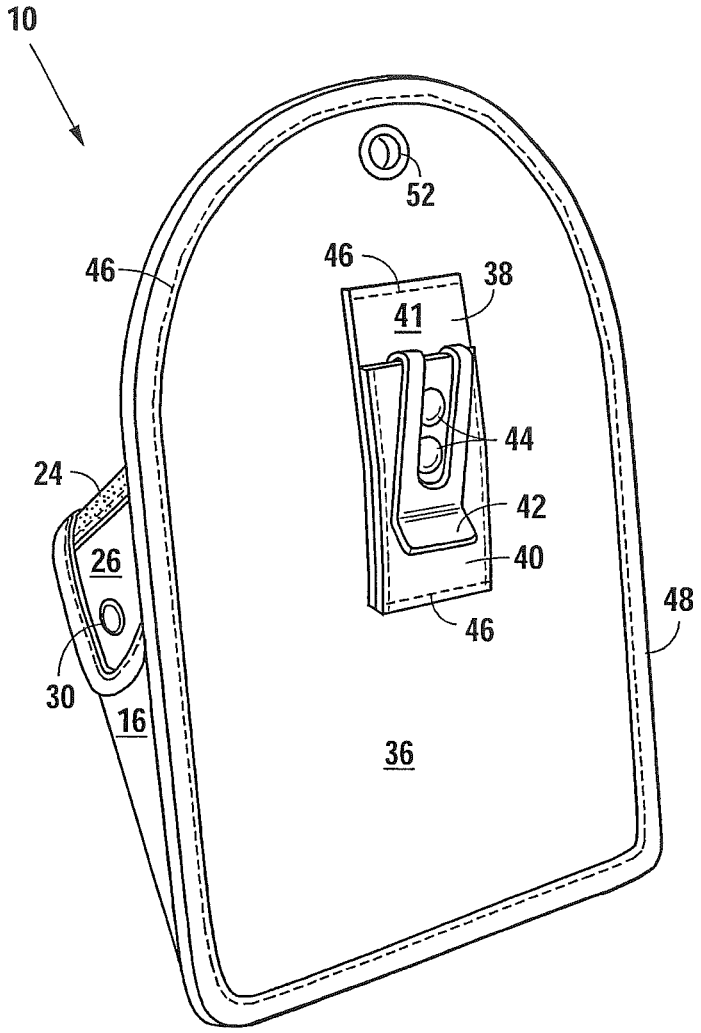
FIG. 2 is a right side rear perspective view of the present invention.

Referring now to FIG. 2, first strip 38 is attached to back surface 36 of back panel 14 by stitching 46, however, other fastening techniques, such as adhesion, riveting or the like, may be used. First strip 38 is attached such that it forms a loop capable of receiving the user's belt therethrough for coupling or attaching tool pouch 10 to the user. A second strip 40 may be attached to the outer surface 41 of the first strip 38 by stitching or other fastening techniques and forming a pocket (not shown) therebetween. Clip 42 is attached with a portion of the clip 42 inserted in the pocket between strip 38 and strip 40 and secured with rivets 44. Though rivets are disclosed in this embodiment, other similar fasteners, such as snaps, buttons or the like, may be utilized.

In the embodiment disclosed in FIG. 2, first strip 38 and second strip 40 are separate pieces. However, it is anticipated that first strip 38 and second strip 40 may be formed of a single strip of material which is folded over and stitched to form the pocket (not shown).

Figure 3:
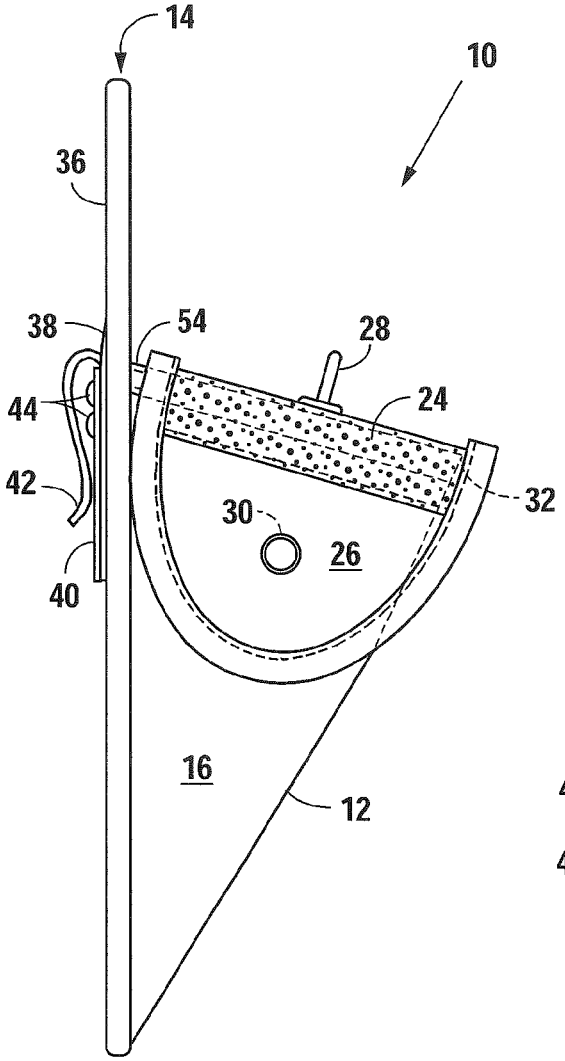
FIG. 3 is a left side elevated view of the present invention with the cover in a closed position.
Figure 4:
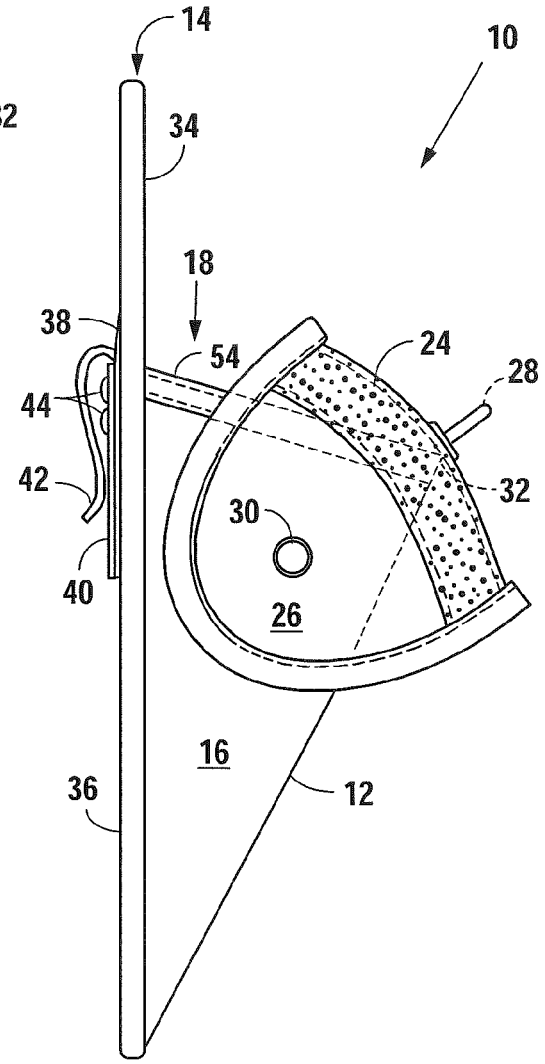
FIG. 4 is a left side elevated view of the present invention with the cover in a partially open position.
Figure 5:
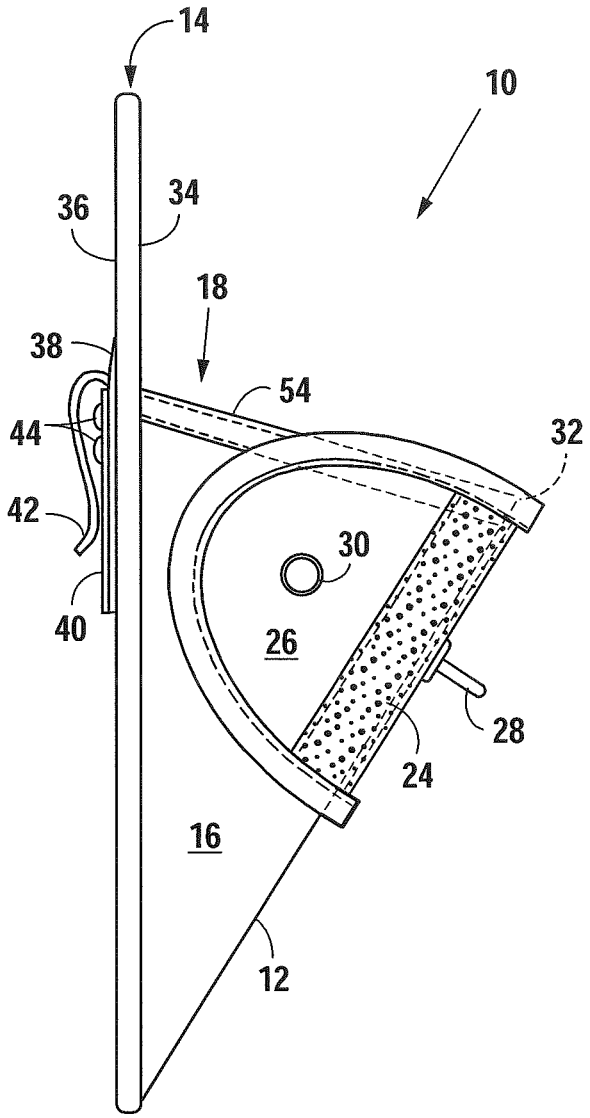
FIG. 5 is a left side elevated view of the present invention with the cover in an opened position.

Referring now to FIGS. 3-5, the present invention is shown in operation with cover 20 in a first or closed position (FIG. 3), transitioning into a partially opened configuration (FIG. 4), then to a second fully opened position (FIG. 5) by rotating about rivet 30. Referring now to FIG. 3, cover 20 is in a first position wherein cover 20 is closed over and covers cavity 18. Flexible strips 24 allow cover 20 to bend around top edge 54 (shown in FIGS. 3-5) of side panels 16 when cover 20 is in the first position covering cavity 18. In this configuration, flexible strips 24 remain sufficiently taut over top edge 54 to secure and hold cover 20 in place. Corners 32 (only one of which is shown) act as additional barriers to prevent cover 20 from moving from the first position. In this first position, contents placed within the cavity 18 of tool pouch 10 stay put. Cover 20 can reside in the closed position even if tool pouch 10 is radically reoriented, such as by the user moving from a standing vertical position to a kneeling primarily horizontal position.

Referring now to FIG. 4, cover 20 is rotated about rivets 30 (only one of which is shown) away from front surface 34 of back panel 14 from the first position toward the second, or opened, position (FIG. 5). Flexible strips 24 of cover 20 necessarily stretch to negotiate over corners 32 positioned at the intersection of the top edges of front panel 12 and side panels 16. Flexible strips 24 stretch and bulge at the point of contact and the immediately surrounding area within flexible strips 24 where corners 32 contact the flexible strips 24 as they traverse over corners 32, as shown in FIG. 4. After cover 20 has moved from the first (closed) position (FIG. 3) but before cover 20 is placed in the second (opened) position (FIG. 5), cover 20 is in a position where cavity 18 is partially exposed, as show in FIG. 4.

Referring now to FIG. 5, cover 20 is shown in a second position at approximately 90° relative to the position of cover 20 in the first position. When cover 20 is in the second position exposing cavity 18, flexible strips 24 allow cover 20 to bend around side edges 56 (see FIG. 6) of front panel 12. In this position, flexible strips 24 still remain sufficiently taut so as to secure and hold cover 20 in place in the second position.

Figure 6:
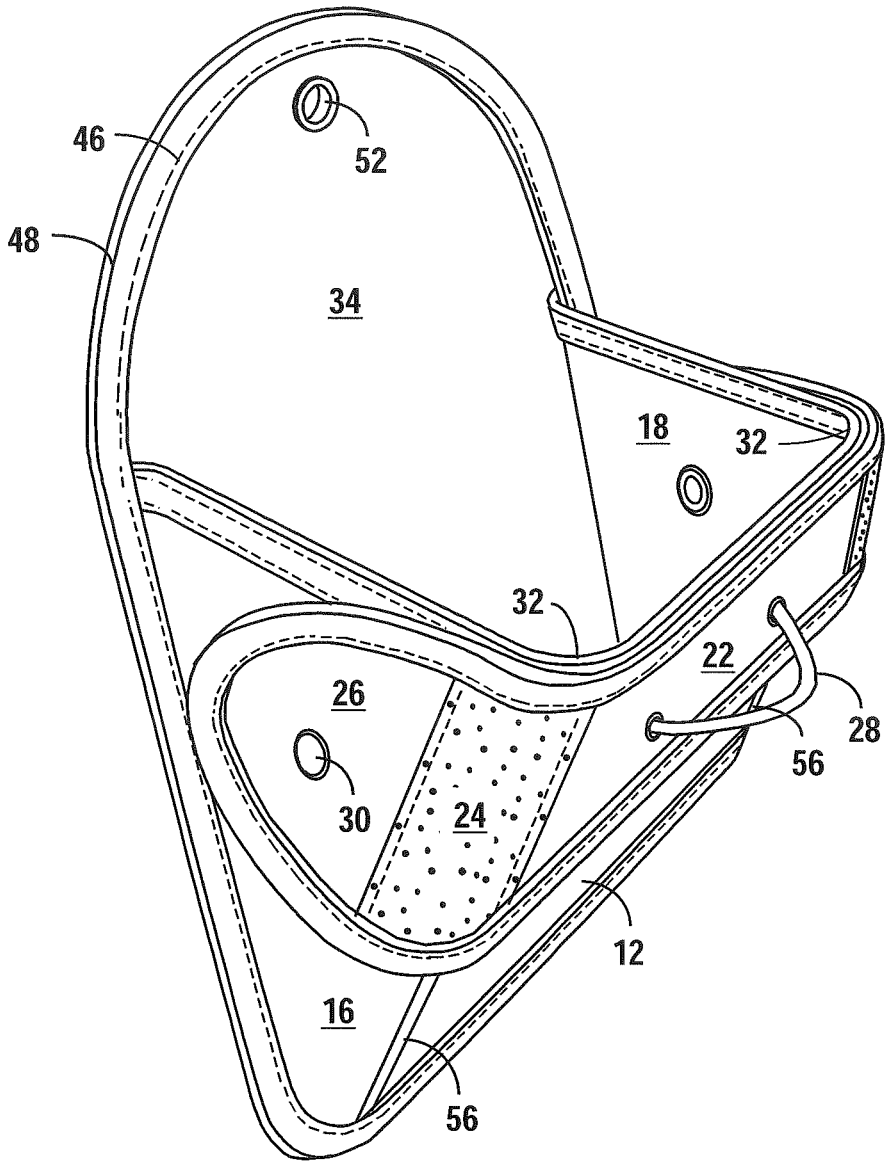
FIG. 6 is a left side frontal perspective view of the present invention with the cover in an opened position.

As shown in FIG. 6, corners 32 act as additional barriers to prevent cover 20 from moving from the second position. In this second position, contents placed within cavity 18 of tool pouch 10 may be accessed by the user. Cover 20 can reside in the opened position even if tool pouch 10 is radically reoriented, such as by the user moving from a standing vertical position to a kneeling primarily horizontal position.

Figure 7:
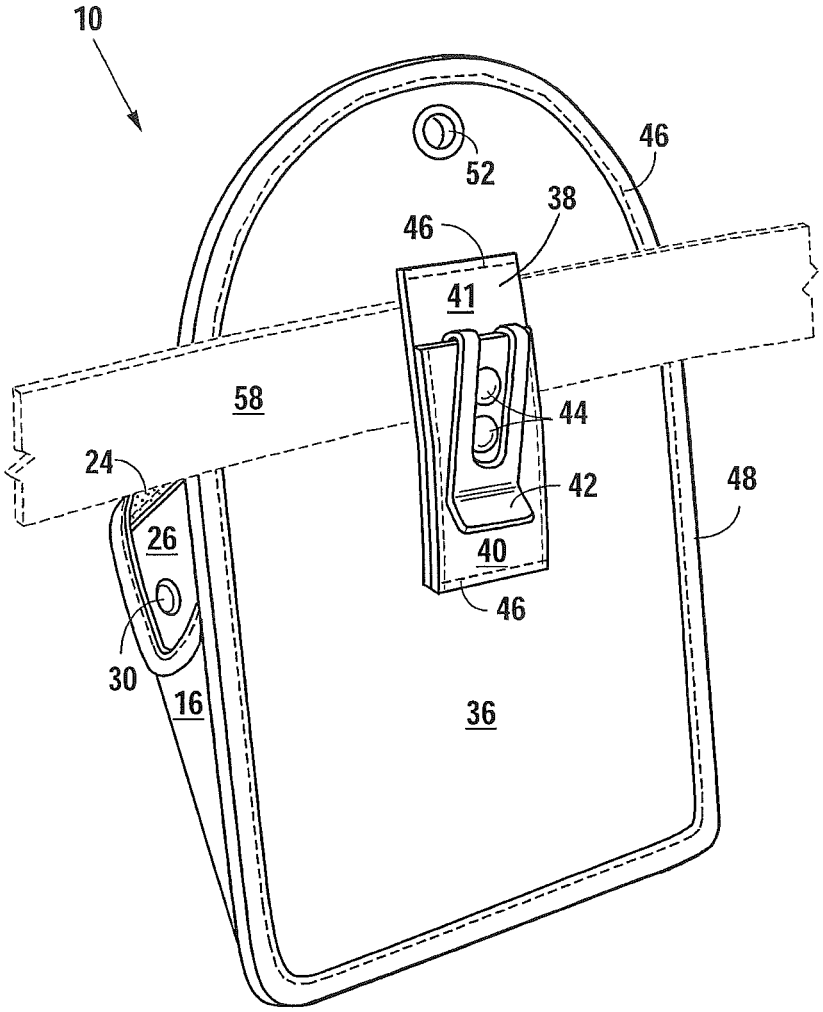
FIG. 7 is a right side rear perspective environmental view of the present invention coupled to a user's belt.

Referring now to FIG. 7, tool pouch 10 may be removably attached or coupled to the user. For example, the loop formed by the attachment of strip 38 is suitable for accepting belt 58 therethrough. The user may slip belt 58 through the loop formed by the attachment of strip 38, thereby securing the tool pouch to the user until the user removes belt 58 from the loop.

Figure 8:
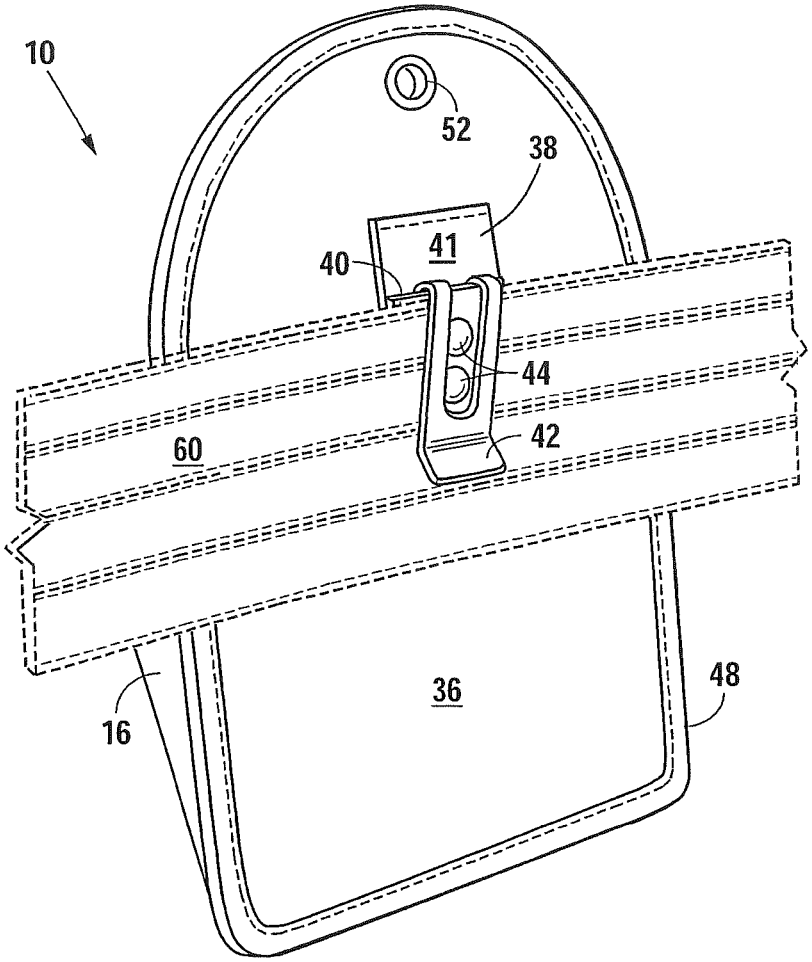
FIG. 8 is a right side rear perspective environmental view of the present invention coupled to a utility belt.

In an alternative method of attachment, it is common for construction workers (e.g., carpenters, electricians, plumbers, etc. . . . ) to use a utility belt for carrying various pouches, tools and accessories on their person when doing a job. FIG. 8 shows an alternative form of attachment of tool pouch 10 to the user. For example, the user may be using a thicker utility belt 60 to accommodate various types of pouches, tools and accessories and can thus couple tool pouch 10 as an additional attachment to the utility belt 60. The user can attach tool pouch 10 to utility belt 60 by clipping clip 42 of tool pouch 10 to a portion of utility belt 60 that readily accepts such attachment, e.g., over the top edge of the utility belt or where a measuring tape can be attached or coupled through similar clipping.

Although a loop or clip 42 are used to couple tool pouch 10 to another device, such as belt 58 or utility belt 60, other types of couplers, such as molly fasteners and the like, may be used.

FIGS. 2 and 7-8 depict the use of at least two rivets 44 to attach or couple clip 42 to back surface 36 of back panel 14. In an alternative embodiment, clip 42 may be attached on top of strip 40 or attached directly to the back panel 14, rather than between strips 38 and 40. In this embodiment, a single rivet or like fastener, such as a snap, button or the like, can be used. A single rivet or like fastener allows clip 42 of tool pouch 10 to rotate about the single rivet or fastener to allow tool pouch 10 to remain in an upright position normal to the ground or surface even when the user is in a non-standing position.

When the user is in a standing position, tool pouch 10 is oriented such that its position is upright with respect to the ground or surface. When the user bends down to crawl on hands and knees (e.g., when needing to enter into a crawl space), clip 42 of tool pouch 10 rotates about the single rivet or other similar fastener so that, instead of changing to a position that is parallel to the ground or surface as a result of the user changing to a crawling position, the position of tool pouch 10 remains upright with respect to the ground or surface. In doing so, the contents within tool pouch 10 have not shifted (or have shifted slightly) and tool pouch 10 may be opened, as described above, without the contents spilling out. This is especially beneficial when the user is in an area with little or no light and the contents are sharpened items (e.g., small nails or other sharpened items) that could otherwise cause injury to the user if they were to spill out while the user is on hands and knees and the user happened across the spilled contents in such a confined and possibly unlit or dimly lit area.

The user may store tool pouch 10 when tool pouch 10 is not being used. To store tool pouch 10, the user may, for example, hang tool pouch 10 on a peg on a wall (not shown) using eyelet 52 (see FIGS. 1-2, 6-8) reinforced with metal or other like material to prevent tearing of tool pouch 10.

In still another alternative embodiment, tool pouch 10 may be a part of a larger tool pouch (e.g., a tool bag or a tool belt) and can also include one or more pockets on front panel 12 and side panels 16 which may be integrally formed with tool pouch 10 during the manufacturing process and/or added later. Additional pockets may be secured to tool pouch 10 by stitching, rivets, hooks, adhesion, hook-and-loop fasteners, and/or any other appropriate technique.

The present invention is described above in terms of a preferred illustrative embodiment of a specifically described tool pouch for securing articles therein, as well as alternative embodiments of the present invention. Those skilled in the art will recognize that alternative constructions and implementations of such tool pouch including different sizes and/or arrangement of components can be used in carrying out the present invention. Other aspects, features, and advantages of the present invention may be obtained from a study of this disclosure and the drawings, along with the appended claims.

I claim:

1. A tool pouch comprising:

a front panel;

a back panel;

at least two side panels connecting said front panel to said back panel, wherein said at least two side panels, said front panel and said back panel define a cavity therebetween; and a cover having a top and a first side and a second side extending from opposing ends of said top;

said first side and said second side being pivotally attached to said at least two side panels; and said cover being pivotable between a first position and a second position; and wherein said cover further comprises flexible strips connected between said first side and said top and said second side and said top.

2. The tool pouch, as recited in claim 1, wherein when said cover is in said first position, said cavity is closed by said cover.

3. The tool pouch, as recited in claim 1, wherein when said cover is in said second position, said cavity is open.

4. The tool pouch, as recited in claim 3, wherein said second position is at approximately 90° relative to said first position.

5. The tool pouch, as recited in claim 1, wherein said first side and said second side of said cover are attached to said at least two side panels using rivets.

6. The tool pouch as recited in claim 1 wherein said flexible strips are resilient.

7. The tool pouch, as recited in claim 1, wherein said flexible strips are made from a high strength woven stretchable material.

8. The tool pouch, as recited in claim 7, wherein said high strength woven stretchable material is elastic.

9. The tool pouch, as recited in claim 1, further comprising a strap attached to said top of said cover.

10. The tool pouch, as recited in claim 9, wherein said strap is of elastic material.

11. The tool pouch, as recited in claim 1, further comprising a reinforcement portion attached to the perimeter of said front panel, said back panel, said at least two side panels, and said cover.

12. The tool pouch, as recited in claim 11, wherein said coupler is a clip adjacent to said back surface of said back panel.

13. The tool pouch, as recited in claim 1, further comprising a coupler attached to a back surface of said back panel.

14. The tool pouch, as recited in claim 13, wherein said coupler is at least one strip attached to said back surface of said back panel, said at least one strip and said back surface of said back panel defining a loop.

15. A pouch comprising:

a front panel;

a back panel;

at least two side panels connecting said front panel to said back panel, wherein said at least two side panels, said front panel and said back panel define a cavity therebetween;

a cover having a top and a first side and a second side extending from opposing ends of said top;

said first side and said second side being pivotally attached to said at least two side panels;

said cover being pivotable from a closed position to an open position;

a coupler attached to said back panel; and at least one fastener attaching said coupler to said back panel, wherein said coupler rotates about said at least one fastener; and wherein said cover further comprises flexibility strips connected between said first side and said top and said second side and said top.

16. The tool pouch, as recited in claim 15, wherein said flexible strips are resilient.

* * * * *